United States Patent [19]

Capes et al.

[11] 4,082,515

[45] Apr. 4, 1978

[54] COKE OVEN SYSTEM AND AGGLOMERATING CARRYOVER FINES THEREIN

[75] Inventors: C. Edward Capes; Allen E. McIlhinney, both of Ottawa, Canada; Leonard Messer, Pittsburgh, Pa.

[73] Assignee: American Minechem Corporation, Coraopolis, Pa.

[21] Appl. No.: 758,651

[22] Filed: Jan. 12, 1977

[51] Int. Cl.[2] ..... B01J 1/00; C08L 95/00; C09C 1/58; C10B 53/04

[52] U.S. Cl. ..... 23/313 R; 23/314; 44/1 F; 106/273 R; 106/281 R; 106/284; 201/4; 201/6; 201/23; 201/28; 201/42; 202/82; 264/117; 423/445; 423/449

[58] Field of Search ..... 201/3, 4, 5, 6, 7, 8, 201/21, 22, 23, 28, 40, 42, 45; 202/81, 82, 99, 262; 23/313 R, 314; 44/1 F, 10 C, 10 K, 10 J, 6; 264/117; 423/445, 449

[56] References Cited

U.S. PATENT DOCUMENTS

| | | | |
|---|---|---|---|
| 2,933,796 | 4/1960 | Somogyi | 264/117 X |
| 2,948,948 | 8/1960 | Duplin, Jr. et al. | 264/117 X |
| 3,404,960 | 10/1968 | Mansfield | 423/449 |
| 3,424,556 | 1/1969 | Johnson | 423/449 |
| 3,457,141 | 7/1969 | Schmidt | 201/8 X |
| 3,617,228 | 11/1971 | Smit | 264/117 X |
| 3,992,266 | 11/1976 | Aktay et al. | 201/8 |

*Primary Examiner*—Joseph Scovronek
*Attorney, Agent, or Firm*—Reed, Smith, Shaw & McClay

[57] ABSTRACT

A coke oven system is provided having a coke oven preferably with pipeline charging for converting coal into coke. Carryover fines are collected from the coke oven and preferably a preheater therefor, and then agitated by agitator means and the collected carryover fines thereby agglomerated. Preferably, the carryover fines are first mixed with water to form an aqueous mixture, and then agglomerated. The agglomerated carryover fines are then preferably separated from the aqueous mixture by separated means. The agglomerated carryover fines are preferably conditioned in dryer means and recirculated to the coke oven preferably through a preheater.

24 Claims, 2 Drawing Figures

COKE OVEN SYSTEM AND AGGLOMERATING CARRYOVER FINES THEREIN

FIELD OF THE INVENTION p The present invention relates to coke ovens and their operation.

BACKGROUND OF THE INVENTION

A coke oven is used for making coke from coal. The crushed coal is indirectly heated to generally above 1500° F in an oxygen deficient, pressurized atmosphere by heating the sidewalls of the oven with oil, gas or coal. Coal tar volatiles are driven-off from the coal, leaving behind coke for use in making iron and steel. The liberated coal tar volatiles are separately collected and distilled to provide as a by-product a basic raw material for the chemical industry.

One of the problems with coke ovens has been loss of coal as carryover fines. That is, fine coal particles, in various stages of devolatilization and carbonization, are emitted from the coke oven through the exit mains with the volatiles. In a conventional oven, the amount of carryover fines usually runs between 50 and 100 pounds per charge. These carryover fines are generally collected in a dust collector, wet scrubber and pitch trap along with some coal tar and ash, and disposed of as waste.

Recently, it has been found that the efficiency of coke ovens can be substantially improved by preheating the coal. Preheating also permits utilization of lower grades of coal and provides an improved coke product. Preheating involves flash heating typically pulverized coal to about 500° F before charging to the coke oven. The coking can thus be done faster with added production for a given size coke oven, while producing a stronger more consistent coke composition from coal blends comprising large portions of low grade coal. Preheating is credited with providing greater assurance of complete coking and also reducing air polluting emissions that take place when green coke is pushed.

The problem is that preheating also causes even larger losses of coal due to increases in carryover fines. The grinding of coal to fine particles and the explosive force exerted on flash heating produce this increased carryover. The high and efficient yield of usable coke from low-grade coal, however, more than offsets the losses in carryover fines. It has been suggested to use clarifiers to retrieve coal fines trapped by spray water and recycle these to the preheater, but this procedure adds to the cost of installation and operation and still results in loss of substantial carryover fines.

A compounding problem with coke ovens is air pollution during charging. It has been estimated that 70 percent of all emissions from a coke oven occur during charging. A prominent solution for this problem, which has been commercially used, is pipeline charging. Pipeline charging involves grinding and screening the coal to form a mass of coal particles with a maximum size of ¼ inch and most under ⅛ inch. This mass can be pressurized typically by steam and propelled through pipes to charge the coke oven. The big attraction for this system is that the coal enters the ovens through a closed stationary network, with little opportunity for dust emissions.

Pipeline charging, however, further increases the tendency of fine coal particles to carryover to the oven exhaust system. With preheating, anywhere between 200 and 1000 pounds of carryover fines will typically flow into the exit mains during a pipeline charge, with the equipment designed to handle 2000 pounds of carryover fines. See Iron Age (Mar. 1, 1976) pp. MP-9 to 12. The stringencies of recent environmental controls on coke ovens require these losses be accepted.

The present invention overcomes these difficulties and disadvantages. It provides a closed coke oven system where substantially all carryover fines are reclaimed and recycled to the coke oven with minimum cost in equipment and operation. The most pertinent art is believed to be the disclosures of U.S. Pat. Nos. 3,268,071, 3,617,228, 3,637,464, and 3,665,066 and Canadian J. of Chem. Eng., Vol. 54 Feb./Apr. 1976, pp. 3–12, which have little or no relation to the present coke oven system.

SUMMARY OF THE INVENTION

A coke oven system is provided that is an essentially closed system reclaiming virtually all carryover fines at low cost. Air pollution and effluent emissions are minimized.

The coke oven system comprises a coke oven for converting coal into coke, and preferably preheater means for preheating the coal to at least about 500° F before charging to the coke oven. Preferably the coal is charged to the coke oven pneumatically by pipeline charging. The system has collector means on the coke oven and preheater means, if used, for collecting carryover fines from the emissions from the coke oven and preheater.

The collected carryover fines, which include liberated coal tar volatiles, are preferably blended and mixed to form a mass of carryover fines with liberated coal tar throughout. Coal fines feed, which contains coal tar, in an unliberated state, may be added to the blend, if desired, to reduce the percentage of liberated coal tar in the blend and increase the hardness of the agglomerated product. The aqueous mixture is then circulated to agitator means for agitating and agglomerating the collected carryover fines.

Preferably, agglomeration is performed by first circulating the blend to mixing means for mixing the collected carryover fines with water to form an aqueous mixture. The aqueous mixture is then circulated to the agitator means and there agglomerated. The agglomerated carryover fines are then separated from the aqueous mixture by separator means.

By this procedure, the agglomerated carryover fines can be used as a separate by-product of the coke oven system. Preferably, however, the agglomerated carryover fines are circulated to dryer means for conditioning the agglomerate carryover fines for recharging to the system. The dried and conditioned agglomerated carryover fines are then charged by recycle means to the coke oven or preheater along with coal feed.

Other details, objects and advantages of the invention will become apparent as the following description of the presently preferred embodiments and presently preferred methods of practicing the same proceed.

BRIEF DESCRIPTION OF THE DRAWINGS

In the accompanying drawings are shown the presently preferred embodiments of the invention and are illustrated presently preferred methods of practicing the same, in which.

DESCRIPTION OF THE PREFERRED EMBODIMENTS

Figure 1:
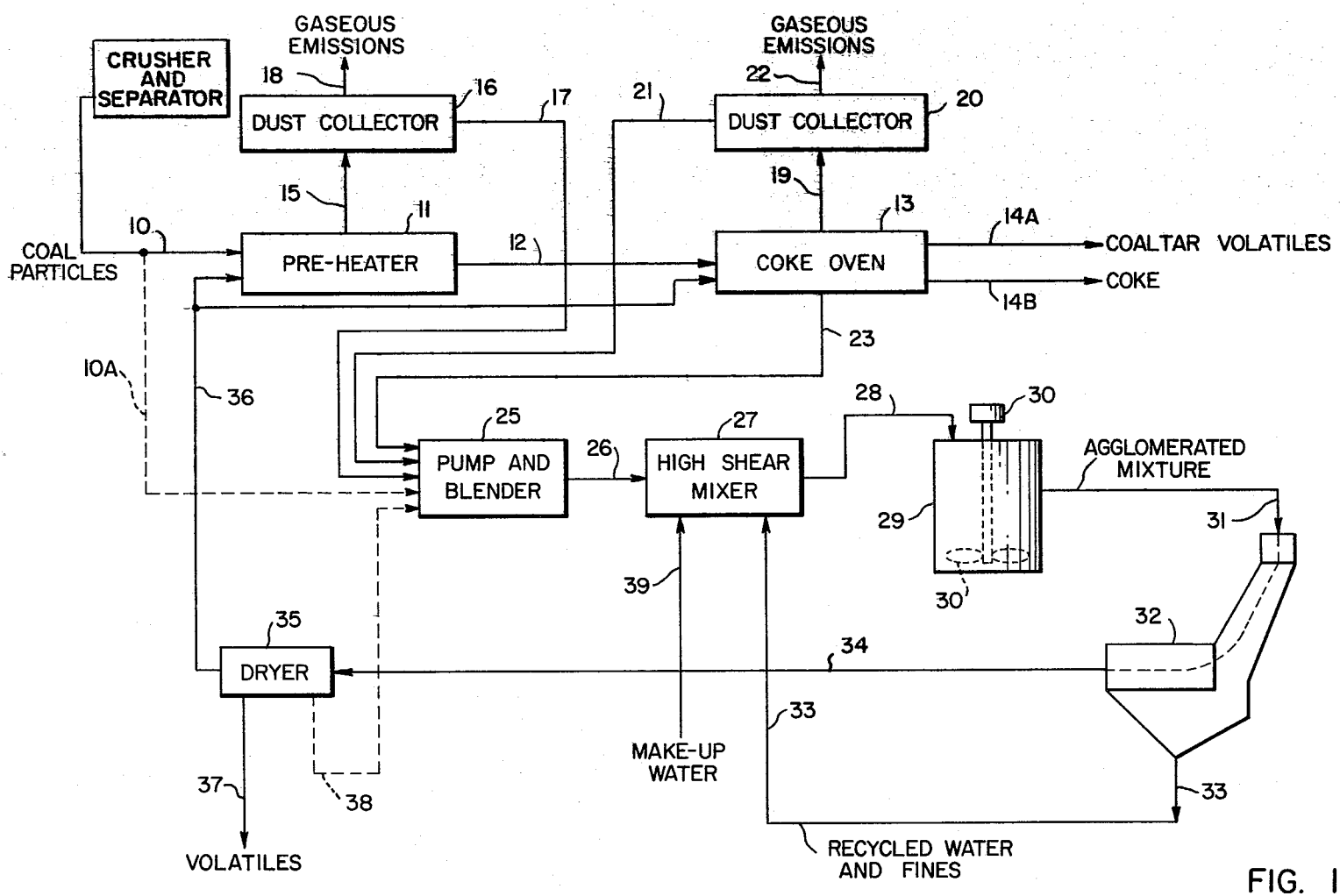
FIG. 1 is a schematic of a coke oven system illustrating the present invention.

Referring to FIG. 1, a coke oven system is illustrated. Coal particles 10 preferably of maximum particle size of ¼ inch and most under ⅛ inch are charged to the system. The coal particles are preferably prepared by grinding in a rotating cone crusher or the like and wet screening of coal. Coal particles 10 are typically dried to a moisture content of about 10 to 15 percent.

Coal particles 10 are charged to preheater 11 where the coal particles are flash heated to about 500° F in about 5 to 8 seconds, preferably with waste gas from the coke oven. The preheated coal particles 12 are then charged to the coke oven 13, which is of a standard design. Preferably, the charging to coke oven 13 is done pneumatically by pipeline charging. In the coke oven 13 the coal particles are heated to about 1500° to 1850° F, driving off the coal tar volatiles 14A and producing furnace or foundry coke 14B, as desired.

In preheater 11, considerable airborne particulate emissions are produced due to the extremely rapid and high temperature heating of the fine coal particles 10. The moisture content in coal particles 10 causes some particles to virtually explode and fragment during the rapid heating. The carryover fines 15 are collected from the preheater 11 and circulated to dust collector 16, where the carryover fines 17 are separated from the gaseous emissions 18. The separated carryover fines are often referred to as preheat filter cake and ash pit residues depending on the particular technique of separation in dust collector 16. Typically, dust collector 16 is a series of cyclone separators and wet scrubbers in combination, where the fines from the cyclones are collected in an ash pit and the fines from the scrubbers are collected as filter cake.

Similarly, airborne particulate emissions 19 from coke oven 13 are emitted through an exhaust main and circulated to dust collector 20, where carryover fines 21 are collected as filter cake and ash pit residues and separated from gaseous emissions 22. Again typically, dust collector 20 is a series of cyclone separators and wet scrubbers in combination. These carryover fines include substantial quantities of coal tar volatiles liberated from the coal in the coke oven. Also carryover fines 23, which include substantial coal tar, are collected from the pitch trap of the coke oven 13.

Typical compositions of the collected carryover fines are as follows:

| | filter cake | ash pit | pitch ash |
|---|---|---|---|
| Moisture content* | 50.0% | 20.0 | 20.0 |
| Tar (oil content of solids)** | 25.0% | 31.2 | 41.4 |
| % of ash in solids*** | 17.3% | 5.6 | 6.0 |

*Moisture content is weight % of water of carryover fine feed.
**Weight % of toluene extractable oil on a water free basis
*Weight % on oil free and water free basis The carryover fines 17 collected from preheater 11 and the carryover fines 21 and 23 collected from coke oven 13 are then pumped and blended in a suitable blender 25**. The carryover fines are blended to provide sufficient liberated coal tar, preferably 3 to 30 percent and most desirably 5 to 20 percent by weight on a wet basis of the carryover fine feed, to insure effective agglomerating in a later step of the process. In this connection, it should be noted that "liberated coal tar" means that the coal tar attains a freed state, by heating, separate from or along with the coal particles in various stages of coking.

Sufficient liberated coal tar is present in an indiscriminate blend of the carryover fines from the coke oven and preheater, which in a typical system is 80 percent from the cyclone separators (i.e. ash pit), 19 percent from the wet scrubbers (i.e. filter coke) and 1 percent from the pitch trap. However, if too much liberated coal tar is present to provide agglomerates of sufficient hardness to withstand recirculation to the coke oven or preheater, controlled quantities of coal particles 10A, containing unliberated coal tar, can be added to reduce the percentage of liberated coal tar in the blend. Preferably, blender 25 is the feed pump to mixer 27 (hereafter described) that functions to transport and homogenize, possibly in controlled proportions, the separately collected components of carryover fines from the coke oven and preheater. Because of the consistency of the collected carryover fines, with liberated coal tar included, a pump for viscous materials such as Moyno pump, or screw-type feeder is preferred for blender 25.

The blended carryover fines 26 are then preferably mixed and dispersed in water in mixer 27, which for agglomeration of a water dispersion is a high shear mixer. Preferably the dispersion is between 5 and 40 percent and most desirably between 15 and 25 percent carryover fines in water. In mixer 27, the dispersion is agitated and agglomerated to agglomerates of less than ¼ inch and mostly less than ⅛ inch in size. The intensity of mixing and the temperature in mixer 27 control the residence time required and the size of the agglomerates. A temperature of about 50° C is preferred in the mixer and a residence time in the order of 5 seconds to 1 minute. Process heat may be provided by the heat content of the carryover fines, or steam may be injected to achieve the desired temperature. Experimentation in the individual system is necessary to optimize the agglomerate size and hardness. For example, if the agglomerates prove to be too large at 50° C, the temperature could be raised to reduce the viscosity and in turn the agglomerate size, Alternatively, the amount of carryover fines containing small quantities of liberated coal tar can be increased in the feed blend to reduce the agglomerate size and hardness. Coal particles 10A can also be and preferably are proportionally added at the blender 25 to control agglomerate size and hardness. If the agglomerates are too small or hard, the intensity of mixing can be reduced or the amount of carryover fines containing larger quantities of liberated coal tar is increased in the feed blend.

Respecting high shear mixer 27, in one desirable embodiment, a 60 gallon tank with a 14.7 HP. agitator operating at 1500 rpm and an impeller diameter of 14 inches (28 meters/sec. peripheral speed) can be used on a 25 percent carryover slurry. Three turbine impellers mounted at different heights on the shaft and 4 or 8 radial baffles (donut baffles or "stage dividers") can also be used. Such a mixer volume will provide about 20 seconds residence time, which for 10 tons per hour processing rate is expected to be ideal.

After mixer 27, the agglomerated mixture 28 can be circulated to holding or surge tank 29, which is provided with agitator 30. An additional residence time of 2 to 5 minutes can thus be imparted to the mixture to finish forming the agglomerates under a gentler agitation. Depending on the performance of the high intensity mixer discussed above, however, the agitated holding tank 29 may not be needed and the agglomerated mixture 28 can go directly to separator 31.

The agglomerated mixture 31 or 28 is pumped to a separator 32 which separates the agglomerated carryover fines from the water by size and/or density. Preferably, a vibratory dewatering screen, with a suggested mesh size of 65 mesh, is used for separator 32. A coarser mesh (e.g. 30 mesh) may also be used if there is no objection to some fines being recycled with the water. Alternatively, a sieve bend of an appropriate mesh size, such as that manufactured by authority from DSM NV Vedernaldse Staatsmijnen, may be used for separator 32. Other commercially available size separators such as an elutriator, or cyclone or spiral separator may also be utilized. Alternatively, the agglomerated carryover may also be separated in a float-sink tank where the agglomerates, which tend to float, are skimmed off by a rotating paddle through an overflow, while the water and unagglomerated carryover fines, which tend to sink, are removed through the bottom of separator 32 as an underflow 33 substantially free of carryover fines and agglomerates. This underflow is recylced to mixer 27 for use in mixing and agglomerating as above described.

The separated agglomerated carryover fines 34 may then be processed through dewatering means (not shown), such as a centrifuge, to remove water absorbed on the agglomerates. Such separated water is also recirculated back to mixer 27 for reuse. Dewatering apparatus is not, however, necessary or preferred.

Agglomerated carryover fines 34 may be used as a separate commercial product. Preferably, however, the separated agglomerated carryover fines 34 are heated to 500° F in dryer 35 and conditioned by oxidation, hydrolysis, polymerization and the like to a hardened mass. A vibrating, shallow fluid bed dryer is preferred, such as that manufactured by Jeffrey. Generally, about 25 percent water is the design load on dryer 35. This is a maximum figure based on experimentation with a stationary 8-inch sieve screen. With a vibrating dewatering screen in separator 32, the typical moisture content in separated agglomerated carryover fines 34 is expected to be on the order of 10 to 15 percent.

The retention time in dryer 35 is preferably greater than 30 seconds and up to generally 1 hour is contemplated, with the retention time usually on the order of 5 to 20 minutes. And the heating is not as rapid as in preheater 11 so that the agglomerated carryover fines are "conditioned" preparatory for charging to preheater 11 or alternatively coke oven 13. Such conditioning substantially hardens the agglomerates and reduces the fragmentation and carryover emissions for the agglomerates on charging to the preheater by removing volatiles (primarily water) 37. If appropriate, the volatiles 37 may be collected and separated in the dust collector (not shown) and carryover fines 38 circulated to the blender 25. The dried carryover agglomerates 36 are then preferably charged to preheater 11 along with coal particles 10, and subsequently processed into coke in coke oven 13 as above described.

Figure 2:
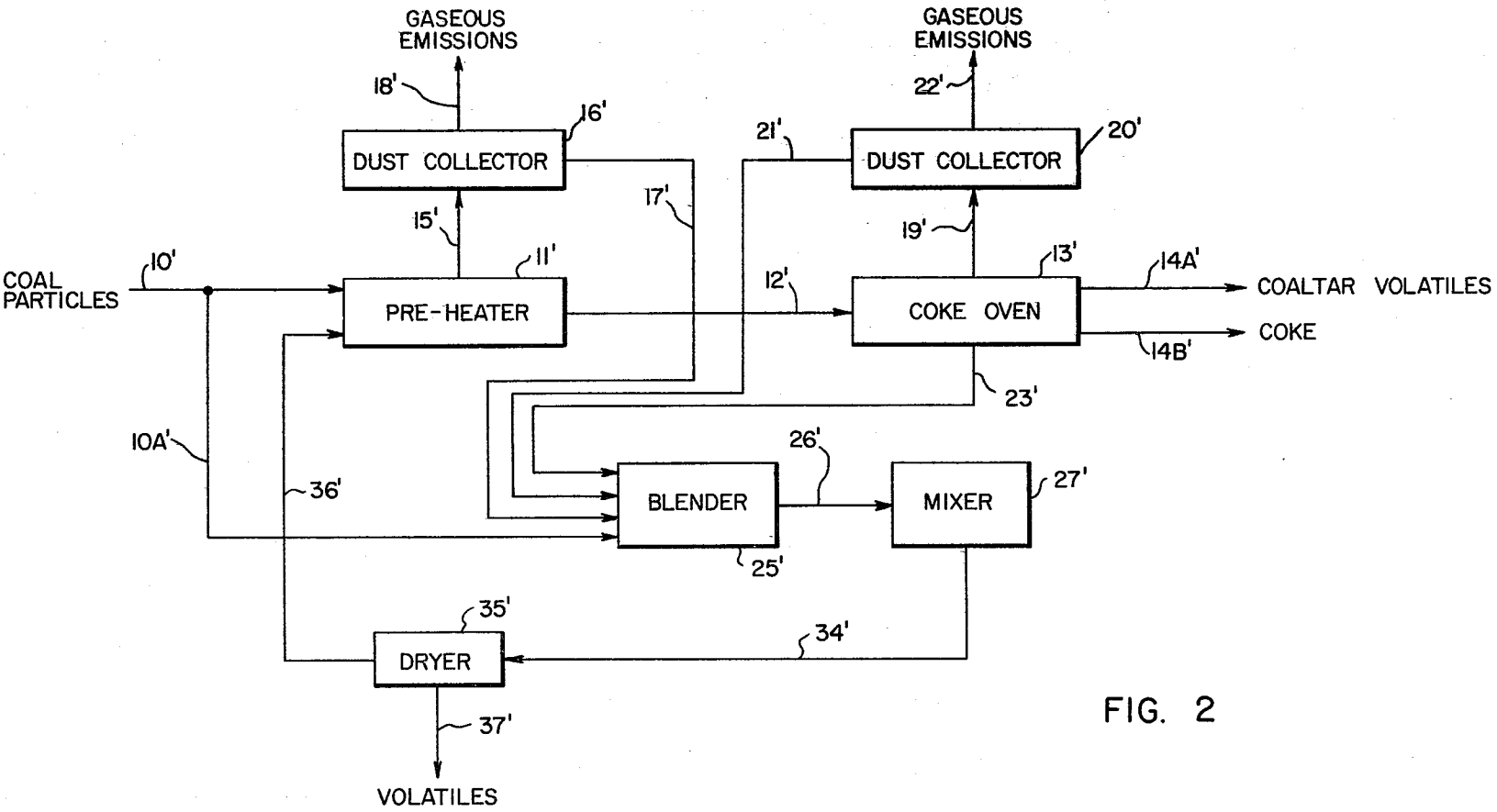
FIG. 2 is a schematic of a coke oven system illustrating the present invention.

Referring to FIG. 2, an alternative coke oven system is illustrated in which the agglomeration is performed under dry conditions. In description of this embodiment, the components are designated with corresponding prime numbers to those described in connection with FIG. 1 to show similarities and differences from the coke oven system and embodied method there described.

Coal particles 10' are prepared as described in connection with FIG. 1 of the same controlled particle size. The coal particles are then charged in preheater 11' and preheated as there described. The preheated coal particles 12' are then charged to coke oven 13', where they are processed into coal tar volatiles 14A' and furnace or foundry coke 14B' as there described. Carryover fines 17' and 21' are collected from dust collectors 16' and 20', respectively and circulated to a mixer 27' through blender 25', if desired, along with the collection 23' from a pitch trap.

In mixer 27', the carryover fines are agitated, preferably under fairly gentle conditions, to form agglomerates. Mixers particularly suitable for this purpose are double arm kneader-mixers, pug mills, paddle mixers, dough mixers and the like.

Generally, the carryover fines will contain too much liberated coal tar. For this reason, coal particles 10A' are usually added to the mixer 27' preferably by mixing with the carryover fines in mixer 25'. To provide good agglomeration, the carryover fines should be preferably 3 to 30 percent and most desirably 5 to 20 percent by weight of the total material passing through the mixer. The residence time in mixer 25' is preferably on the order of 2 to 15 minutes.

The agglomerated carryover fines 34' are then circulated to dryer 35', where the agglomerates are preferably heated and conditioned as above described in connection with FIG. 1. The conditioned agglomerated carryover fines 36' are then preferably recycled to the coke oven system and preferably preheater 11'.

A coke oven system is thus provided which is almost entirely closed. The atmospheric emissions are minimized, and no effluent is produced. Conversely, only small amounts of makeup water 39 need be added to the system to maintain the operation where agglomeration is prepared in an aqueous medium. In addition, no additional components such as heat need be added to the system. And most importantly, essentially all coal charged to the system is processed into coke with minimum expense in capital outlay and operation.

While the preferred embodiments of the invention have been specifically described, it is distinctly understood that the invention may be otherwise variously embodied and used within the scope of the following claims.

What is claimed is:

1. A coke oven system comprising:

A. a coke oven for converting coal into coke;

B. collector means for collecting carryover fines and liberated coal tar from the coke oven; and C. agitator means for mixing the carryover fines and liberated coal tar collected from the coke oven with water to form an aqueous mixture, said agitator means also agglomerating the carryover fines and liberated coal tar collected from the coke oven to form agglomerates.

2. A coke oven system as set forth in claim 1 comprising in addition:

E. dryer means for conditioning the agglomerates for charging the coke oven.

3. A coke oven system comprising:

A. a coke oven for converting coal into coke;

B. collector means for collecting carryover fines and liberated coal tar from the coke oven;

C. agitator means for mixing the carryover fines and liberated coal tar collected from the coke oven with water to form an aqueous mixture; said agitator means also agglomerating the collected carryover fines and liberated coal tar in the aqueous mixture to form agglomerates; and D. separator means for separating the agglomerates from the aqueous mixture.

4. A coke oven system as set forth in claim 3 comprising in addition:

E. dryer means for conditioning the separated agglomerates for charging the coke oven; and F. recycle means for charging the conditioned agglomerates to the coke oven.

5. A coke oven system comprising:

A. a coke oven for converting coal into coke;

B. collector means for collecting carryover fines and liberated coal tar from the coke oven;

C. preheater means for preheating the coal to at least about 500° F before charging to the coke oven;

D. collector means for collecting carryover fines from the preheater;

E. agitator means for mixing the carryover fines and liberated coal tar collected from the coke oven and the carryover fines collected from the preheater means with water to form an aqueous mixture; said agitator means also agglomerating the carryover fines and liberated coal tar collected from the coke oven and the carryover fines collected from the preheater means in the aqueous mixture to form agglomerates; and F. separator means for separating the agglomerates from the aqueous mixture.

6. A coke oven system as set forth in claim 5 comprising in addition:

G. dryer means for conditioning the agglomerates for charging the preheater; and H. recycle means for charging the conditioned agglomerates to the preheater.

7. A coke oven system as set forth in claim 5 comprising in addition:

G. blender means for blending the carryover fines from the preheater with the carryover fines and liberated coal tar from the coke oven to provide the agitator means with a controlled blend of carryover fines from the preheater and carryover fines and liberated coal tar from the coke oven.

8. A coke oven system as set forth in claim 7 comprising in addition:

H. means for circulating fine coal particles to the blender means to further control the blend formed in the blender means.

9. A coke oven system as set forth in claim 5 comprising in addition:

G. crusher and separator means for grinding and screening coal to form a mass of fine coal particles of controlled size before charging the coal to the preheater; and H. pipeline means for pneumatically charging preheated fine coal particles to the coke oven.

10. A coke oven system as set forth in claim 9 comprising in addition:

I. dryer means for conditioning the separated agglomerates for charging the preheater; and J. recycle means for charging the conditioned agglomerates to the preheater.

11. A coke oven system as set forth in claim 10 comprising in addition:

K. blender means for blending the carryover fines from the preheater with the carryover fines and liberated coal tar from the coke oven to provide the mixer means with a controlled blend of carryover fines from the preheater and carryover fines and liberated coal tar from the coke oven.

12. A coke oven system as set forth in claim 11 comprising in addition:

L. means for circulating fine coal particles to the blender means to further control the blend formed in the blender means.

13. A coke oven system comprising:

A. crusher and separator means for grinding and screening coal to form a mass of fine coal particles of controlled size;

B. a coke oven for converting the coal particles into coke;

C. collector means for collecting carryover fines and liberated coal tar from the coke oven; and D. agitator means for mixing said carryover fines and liberated coal tar collected from the coke oven and fine coal particles of the crusher and separator means with water to form an aqueous mixture, said agitator means also agglomerating the carryover fines and liberated coal tar collected from the coke oven and the fine coal particles of the crusher and separator means in the aqueous mixture to form agglomerates.

14. A coke oven system as set forth in claim 13 comprising in addition:

E. separator means for separating the agglomerates from the aqueous mixture; and F. dryer means for conditioning the agglomerates for charging the coke oven.

15. A method of agglomerating coke oven carryover fines comprising the steps of:

A. collecting carryover fines and liberated coal tar from the coke oven of a coke oven system; and B. agitating said carryover fines and liberated coal tar of the coke oven with water to form an aqueous mixture and to agglomerate the carryover fines and liberated coal tar in the aqueous mixture to form agglomerates.

16. A method of agglomerating coke oven carryover fines as set forth in claim 15 comprising in addition:

C. collecting carryover fines from a preheater of the coke oven system, said carryover fines collected from the preheater being agitated in water together with the liberated coal tar and carryover fines of the coke oven to form the aqueous mixture, and also being agglomerated in the aqueous mixture with the carryover fines and liberated coal tar of the coke oven.

17. A method of agglomerating coke oven carryover fines as set forth in claim 15 comprising in addition:

C. separating the agglomerates from the aqueous mixture; and

D. drying the agglomerates for charging the coke oven system.

18. A method of agglomerating coke oven carryover fines comprising the steps of:

A. collecting carryover fines and liberated coal tar from the coke oven of a coke oven system;

B. forming an aqueous mixture consisting essentially of said carryover fines, said liberated coal tar, and water;

C. agitating said aqueous mixture to agglomerate said carryover fines and liberated coal tar to form agglomerates; and D. separating said agglomerates from said acqueous mixture.

19. A method of agglomerating coke oven carryover fines as set forth in claim 18 comprising in addition:

E. collecting carryover fines from a preheater of the coke oven system, said carryover fines collected from the preheater being agitated in water together with the liberated coal tar and carryover fines of the coke oven to form the aqueous mixture, and also being agglomerated in the aqueous mixture with the carryover fines and liberated coal tar of the coke oven.

20. A method of agglomerating coke oven carryover fines as set forth in claim 19 wherein:

the carryover fines collected from the preheater are blended with the carryover fines and liberated coal tar from the coke oven of the coke oven system to form the aqueous mixture.

21. A method of agglomerating coke oven carryover fines as set forth in claim 18 comprising in addition:

E. separating the agglomerates from the aqueous mixture; and

F. drying the agglomerates for charging the coke oven system.

22. A method of agglomerating coke oven carryover fines as set forth in claim 21 comprising in addition:

F. collecting carryover fines from a preheater of the coke oven system, said carryover fines collected from the preheater being agitated in water together with the liberated coal tar and carryover fines of the coke oven to form the aqueous mixture, and also being agglomerated in the aqueous mixture with the carryover fines and liberated coal tar of the coke oven.

23. A method of agglomerating coke oven carryover fines as set forth in claim 22 wherein:

the carryover fines collected from the preheater are blended with the carryover fines and liberated coal tar from the coke oven of the coke oven system to form the aqueous mixture.

24. A method of agglomerating coke oven carryover fines as set forth in claim 18 wherein:

coal fine particles are agitated in water together with the liberated coal tar and carryover fines of the coke oven to form the aqueous mixture, and also being agglomerated in the aqueous mixture with the carryover fines and liberated coal tar of the coke oven, said coal fine particles being blended with the carryover fines and liberated coal tar collected from the coke oven to form the aqueous mixture.

* * * * *